US011583995B2

(12) United States Patent
Barraud et al.

(10) Patent No.: US 11,583,995 B2
(45) Date of Patent: Feb. 21, 2023

(54) PORTABLE DEVICE FOR MARKING A SURFACE USING REMOVABLE TOOLING WITHOUT TOOLS

(71) Applicant: SIC MARKING GROUP, Pommiers (FR)

(72) Inventors: Gérard Barraud, Le Perreon (FR); Denis Naviez, Lyons (FR)

(73) Assignee: SIC MARKING GROUP, Pommiers (FR)

( * ) Notice: Subject to any disclaimer, the term of this patent is extended or adjusted under 35 U.S.C. 154(b) by 0 days.

(21) Appl. No.: 17/550,102

(22) Filed: Dec. 14, 2021

(65) Prior Publication Data

US 2022/0193885 A1 Jun. 23, 2022

(30) Foreign Application Priority Data

Dec. 23, 2020 (FR) ..... 2014008

(51) Int. Cl.
*B25H 7/02* (2006.01)
*B25H 7/04* (2006.01)

(52) U.S. Cl.
CPC ..... *B25H 7/04* (2013.01); *B25H 7/02* (2013.01)

(58) Field of Classification Search
CPC .. B25H 7/04; B25H 7/02; B41J 3/4073; B41J 2/225
See application file for complete search history.

(56) References Cited

U.S. PATENT DOCUMENTS 4,808,018 A * 2/1989 Robertson ..... B44B 5/0095 400/127
10,286,545 B2 * 5/2019 Barraud ..... B25H 7/04
2022/0193885 A1 * 6/2022 Barraud ..... B25H 7/04

FOREIGN PATENT DOCUMENTS

CN 203 450 474 2/2014
FR 3 029 443 6/2016

* cited by examiner

*Primary Examiner* — Yaritza Guadalupe-McCall
(74) *Attorney, Agent, or Firm* — Clark & Brody LP

(57) ABSTRACT

The invention relates to a portable device for marking a surface, including a casing (2) having a front face (6) having a rectangular opening (6A) for the passage of a marking member, the front face (6) of the casing being provided with a stiffening frame (15) surrounding the passage opening (6A), this stiffening frame (15) being provided with an indexing system (18) adapted to cooperate with a complementary indexing system (19) equipping each of the tooling of a series of removable tooling (20A, 20B, . . . ) for positioning the device on the surface to be marked, each removable tooling (20A, 20B, . . . ) of the series and the stiffening frame (15) including at least one of the elements of a magnetic fastening system with two elements, namely a magnet (21A) and a ferromagnetic material (21B).

17 Claims, 9 Drawing Sheets

[Fig. 1]
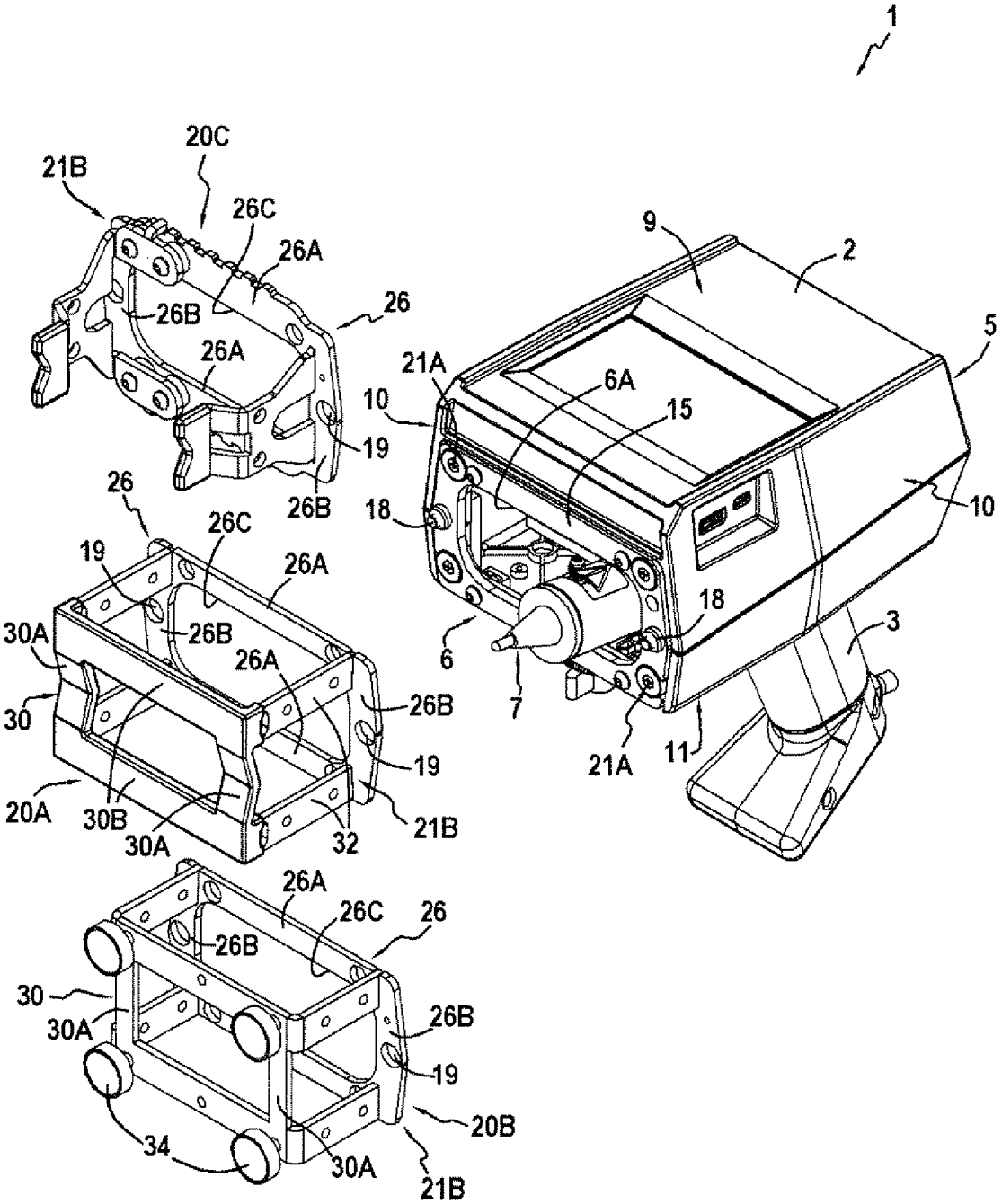

[Fig.2]
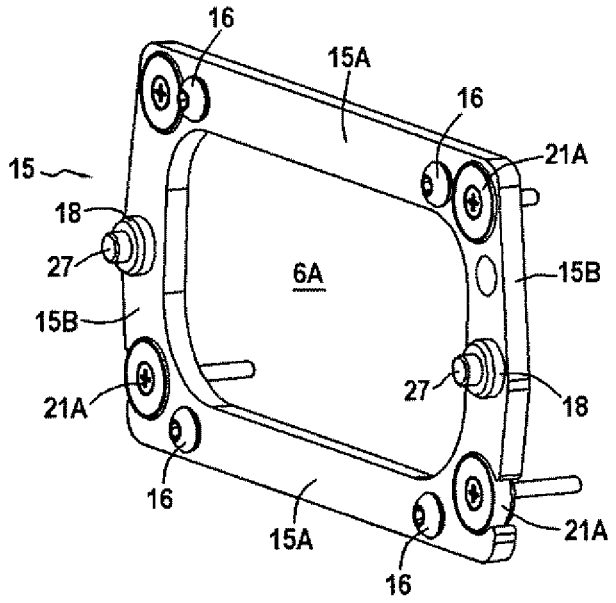
[Fig.3]
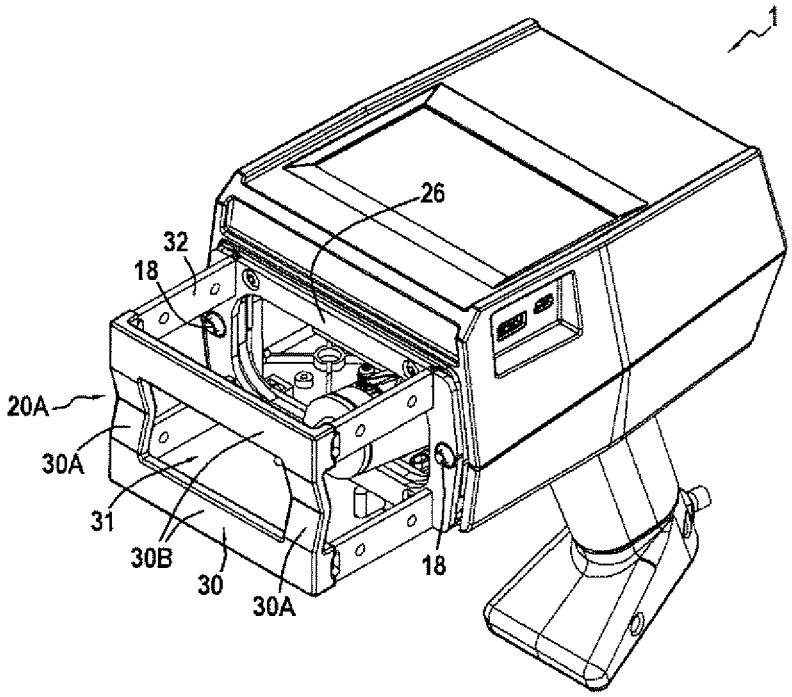

[Fig.4]
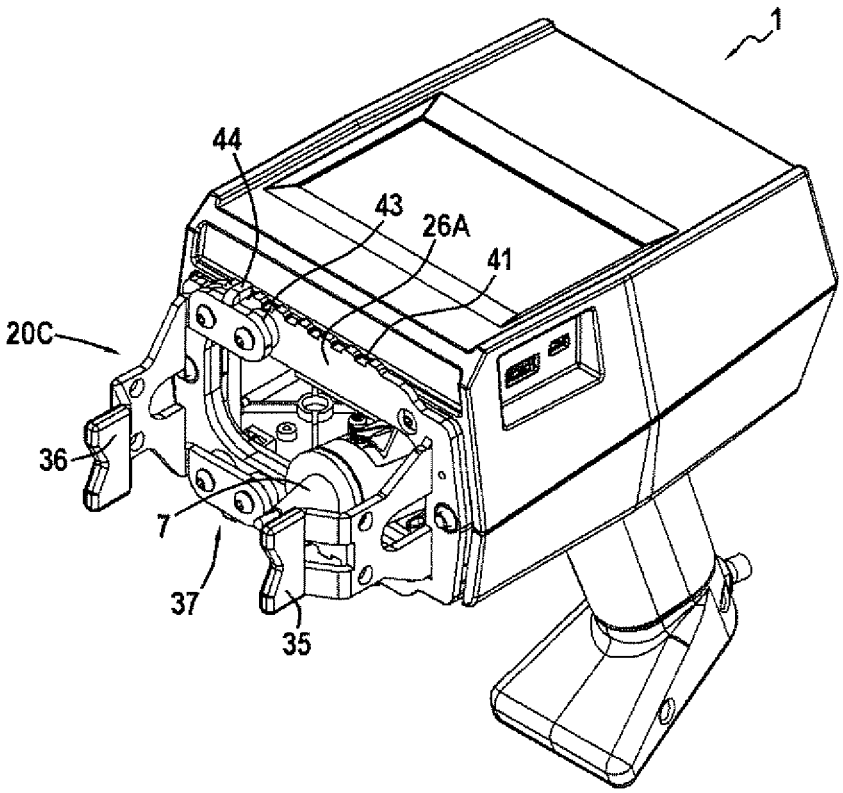

[Fig. 5]
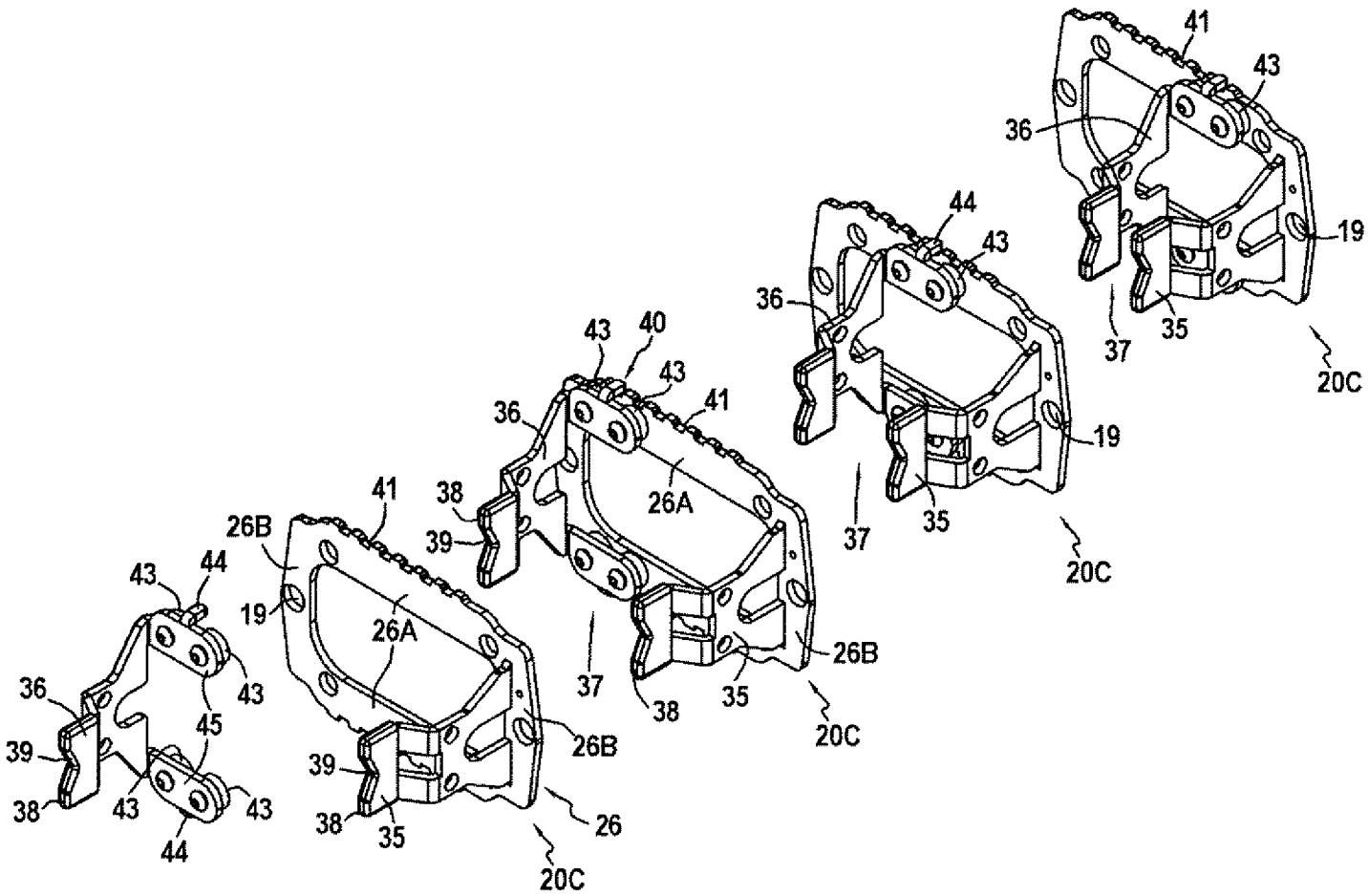

[Fig.6]
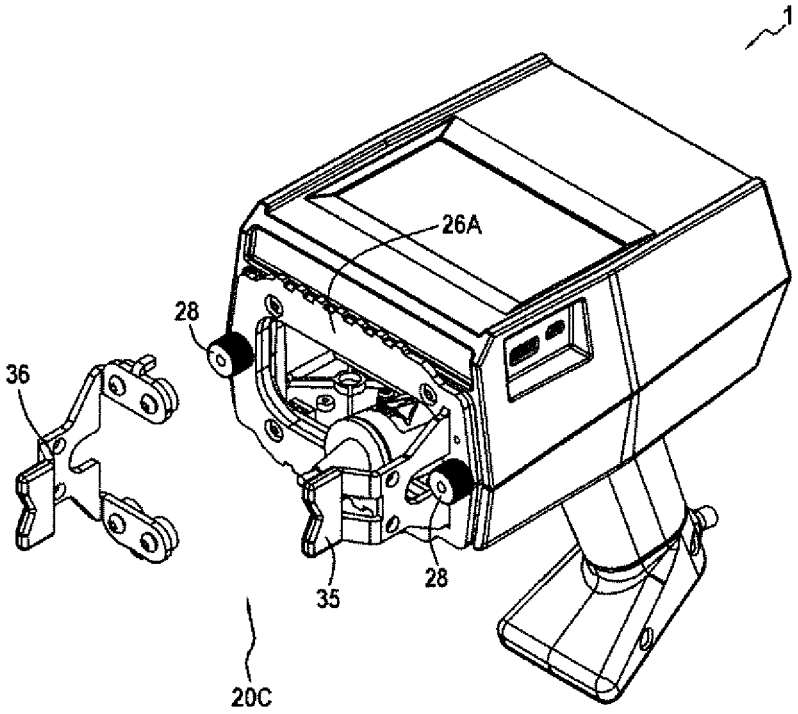

[Fig.7]
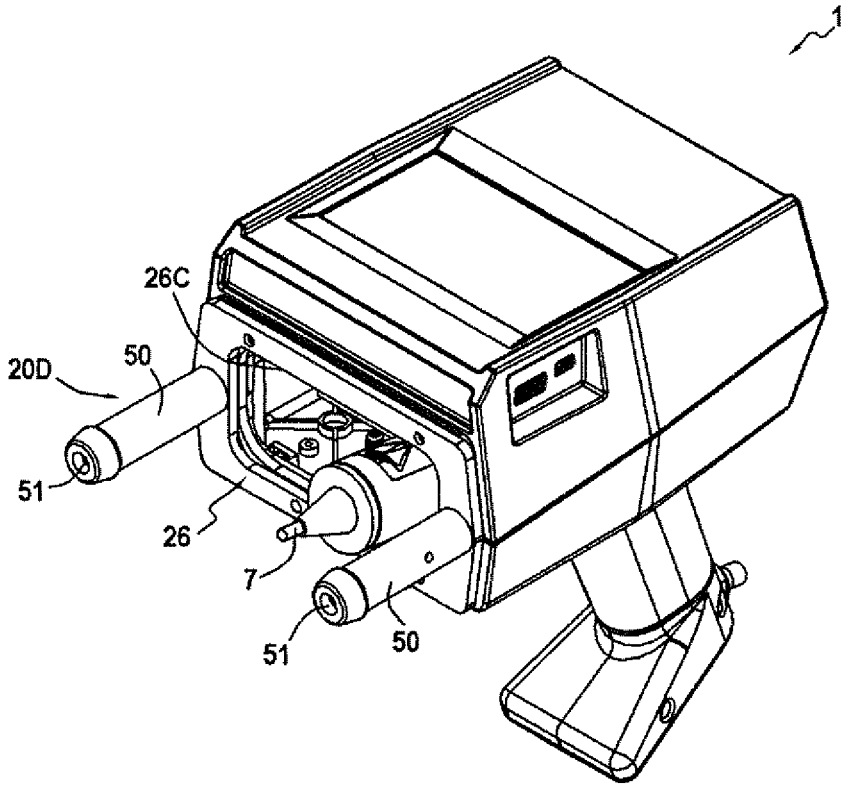

[Fig.8A]
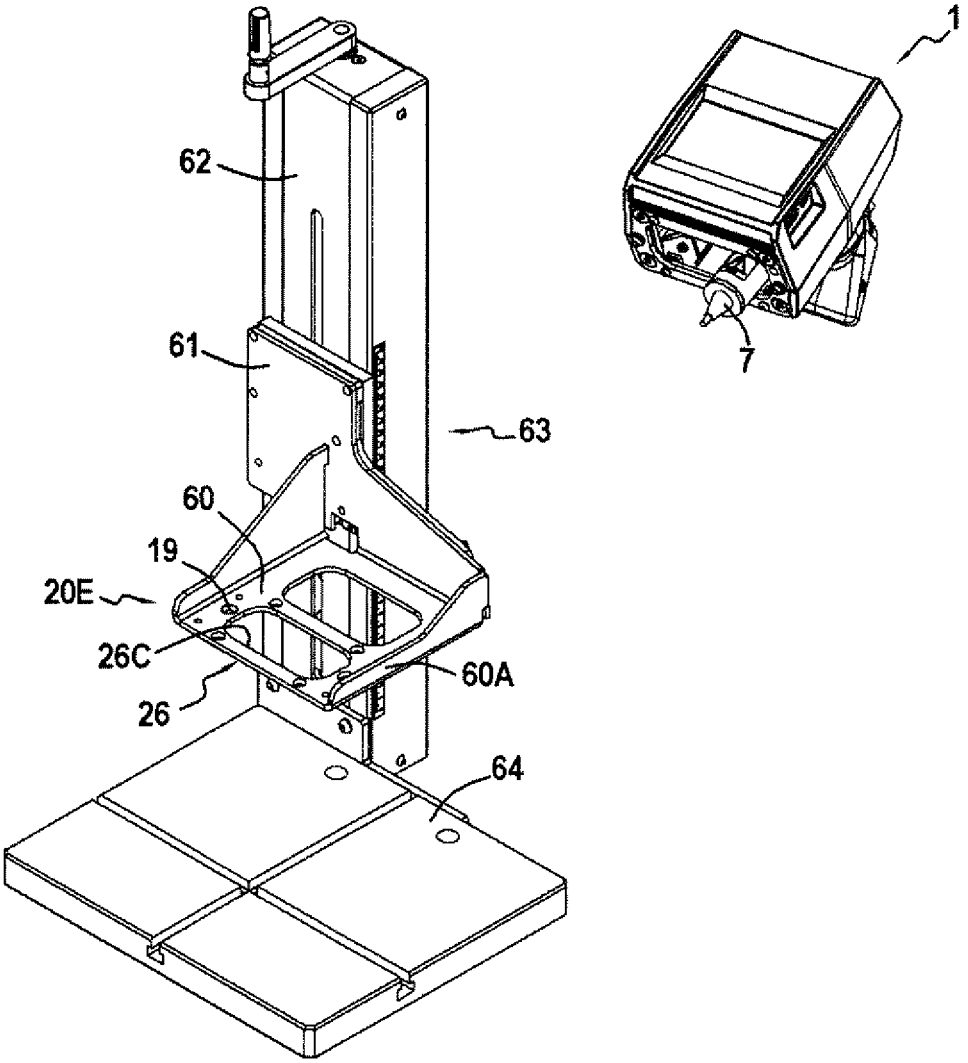

[Fig.8B]
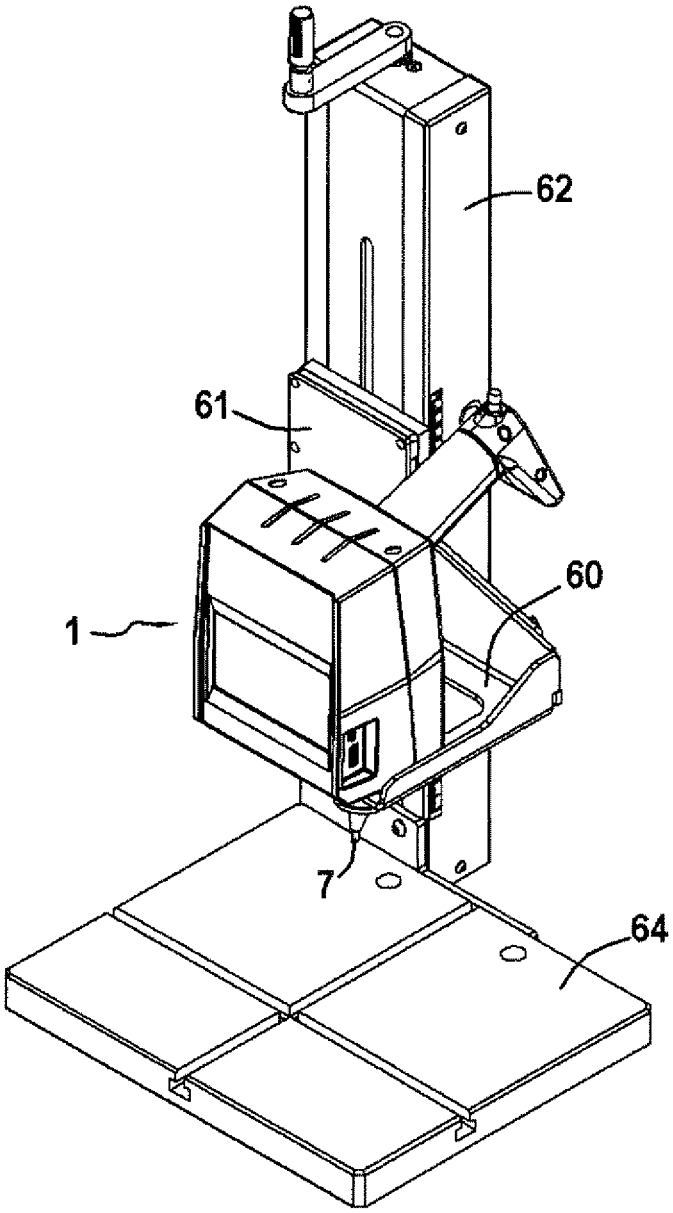

[Fig.8C]
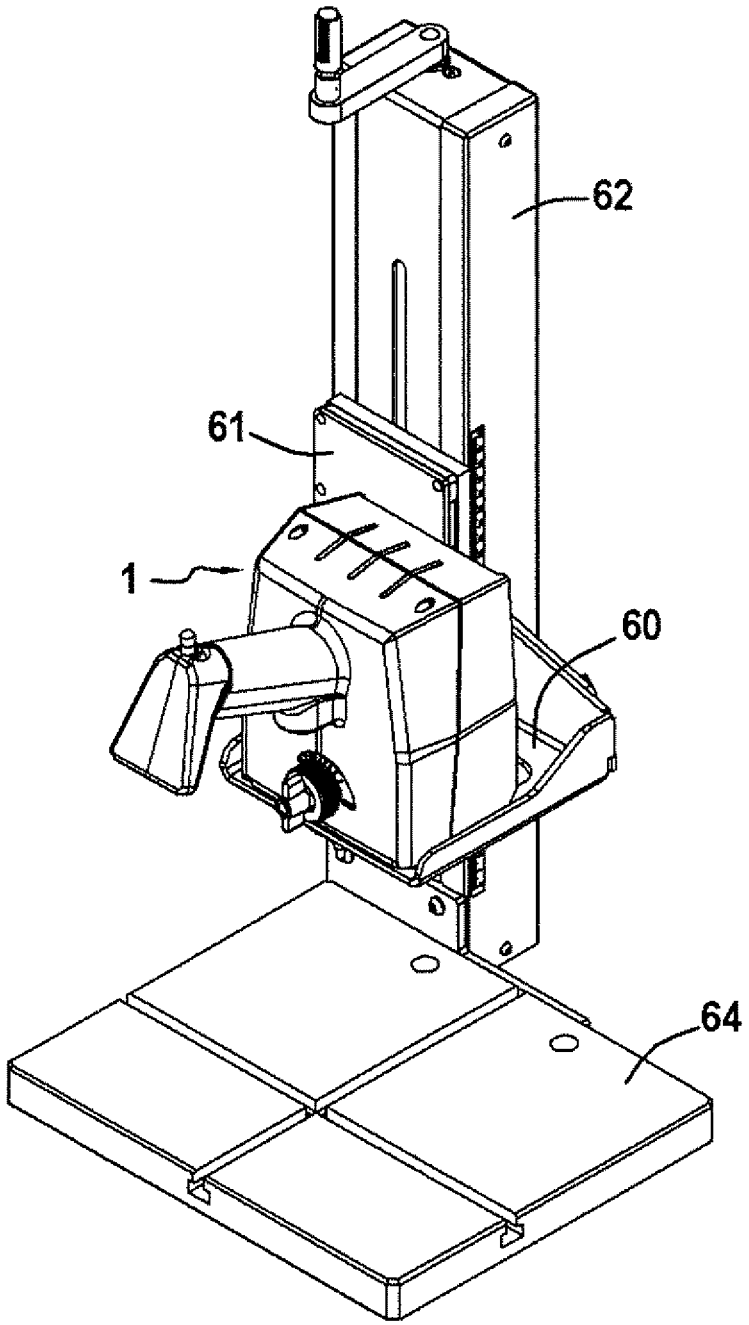

PORTABLE DEVICE FOR MARKING A SURFACE USING REMOVABLE TOOLING WITHOUT TOOLS

TECHNICAL FIELD

The present invention relates to the technical field of portable devices for ensuring the marking of the surface of a part in the general sense and it aims more specifically but not exclusively, at devices for ensuring the marking by deformation of the surface of the part.

PRIOR ART

In the technical field of marking by portable devices, a portable marking device including a casing equipped with a handle and having a front face having a rectangular opening for the passage of a marking member such as a tip is known in particular from patent EP 3 177 435. This marking member is driven in an alternating translational movement to strike the surface to be marked and form a substantially punctual impact. This marking member is also moved in two crossed directions by a movement system, on the surface to be marked in a two-dimensional marking area.

This portable marking device is equipped on its front face with a positioning tooling intended to bear on the part to be marked so as to correctly position the marking member relative to the surface to be marked. It should be noted that a positioning tooling is configured in particular according to the shape and dimensions of the part to be marked. Given the diversity of shapes and/or dimensions of the parts to be marked, the prior art has proposed positioning tooling made in different configurations. Also, a positioning tooling is removably mounted on the portable device to allow it to be changed and the mounting of a positioning tooling adapted to the shape or dimensions of the part to be marked. For example, a positioning tooling is mounted on the portable device using a screw-nut type fastening system requiring the use or not of tools to perform the change operation. In practice, the need to successively mark various parts whose shape and/or dimensions require a change in the positioning tooling often appears. The frequent operations of changing positioning tooling prove to be impractical and relatively time-consuming to complete.

In a complementary manner, a portable marking device is often used in addition to a fixed marking machine including a vertical guide column for a carriage provided with a marking system with a marking member moved in two crossed directions. The position of the carriage along the vertical column can thus be adjusted to allow the part to be positioned between the machine table and the marking member. The use of a portable marking device and a stationary marking machine represents a significant operating cost.

In the prior art, a portable marking device equipped on its front face, with a magnetic positioning tooling for fastening the device on the surface to be marked is also known from document CN 203 450 474. Changing the positioning tooling is done by removing the fastening screws. Also, the operations of changing the positioning tooling prove to be impractical and relatively long to complete.

DISCLOSURE OF THE INVENTION

The object of the invention is to overcome the disadvantages of the prior art by providing a new portable device for marking a surface, adapted to allow the positioning tooling intended to equip such a device to be changed quickly and easily.

Another object of the invention is to provide a device for marking a surface, designed to be portable while also being able to be easily used with a positioning tooling of a stationary machine.

The object of the invention is to provide a portable device for marking a surface, including a casing equipped with at least one handle and having a front face having a rectangular opening for the passage of a marking member forming part of a marking system and adapted to produce at least one substantially punctual mark, this marking member being moved over the surface to be marked, in a two-dimensional marking area. According to the invention, the front face of the casing is provided with a stiffening frame surrounding the passage opening for the marking member, this stiffening frame being provided with an indexing system adapted to cooperate with a complementary indexing system equipping each of the tooling of a series of removable tooling for positioning the device on the surface to be marked, each removable tooling of the series and the stiffening frame including at least one of the elements of a magnetic fastening system with two elements namely a magnet and a ferromagnetic material.

According to a preferred variant embodiment, the stiffening frame is provided with an indexing system including a centering system adapted to cooperate with a complementary centering system of the indexing system equipping at least one removable tooling.

For example, the centering system of the stiffening frame and the complementary centering system of at least one removable tooling are configured to be symmetrical or asymmetrical to allow a respectively reversible or foolproof mounting.

According to a preferred embodiment feature, each removable tooling includes a mounting frame provided with the complementary indexing system, each mounting frame of the removable tooling of the series and the stiffening frame including at least one of the two elements of a magnetic fastening system with magnet and ferromagnetic material.

Advantageously, the stiffening frame of the front face of the casing is magnetized while the mounting frame of the removable tooling of the series has at least a portion made of ferromagnetic material.

According to one embodiment, the stiffening frame of the front face of the casing is attached to the front face of the casing by a fastening system.

For example, the stiffening frame of the front face of the casing is provided with point magnets.

According to an exemplary embodiment, the stiffening frame of the front face of the casing is provided with a centering system by interlocking including at least two male and/or female elements intended to cooperate with two complementary female and/or male elements carried by the mounting frame of at least one removable tooling.

To secure the mounting, at least two male elements of the stiffening frame of the front face of the casing are each extended by a threaded rod intended to pass through the female elements of the mounting frame of at least one removable tooling, so as to receive a nut for fastening the mounting frame on the stiffening frame.

Typically, the mounting frame of at least one removable tooling includes two side uprights parallel to each other and connected by two cross members parallel to each other.

According to one application, the mounting frame of at least one removable tooling includes a support frame located at a distance and in front of the mounting frame, the support frame being fastened to the mounting frame using at least two connection arms extending laterally between the frames.

According to another application, the support frame includes magnets for fastening on the surface to be marked.

According to a different application, the mounting frame of at least one removable tooling includes two support barrels projecting laterally on either side of the mounting frame.

According to another application, the mounting frame of at least one removable tooling with an adjustable window includes a fixed side jamb projecting from one side of the mounting frame and a removable side jamb magnetically fastened on the mounting frame.

Advantageously, the removable side jamb and the mounting frame of the removable tooling with adjustable window include an adjustable system for positioning the removable side jamb along the cross members of the mounting frame.

According to an exemplary embodiment, the adjustable positioning system includes a notching delimiting the housings and arranged on the upper and lower cross members of the mounting frame of the removable tooling with adjustable window and in that the removable side jamb is provided with at least one magnet and two superimposed hooks intended to engage in two superimposed housings to position the removable side jamb relative to the fixed side jamb.

According to another application, the mounting frame of a removable tooling is part of a platen fastened on the sliding carriage of a vertical guide column of a stationary guide machine.

BRIEF DESCRIPTION OF THE DRAWINGS

FIG. 1 is a perspective view of a portable device in accordance with the invention illustrated with three different removable tooling each adapted for use with the portable device in accordance with the invention.

FIG. 2 is a perspective view on a large scale showing an example of a removable stiffening frame intended to be fastened on the front face of the casing of a portable device in accordance with the invention.

FIG. 3 is a perspective view of a portable device in accordance with the invention equipped with a first exemplary embodiment of a removable tooling.

FIG. 4 is a perspective view of a portable device in accordance with the invention equipped with a removable tooling with an adjustable window.

FIG. 5 illustrates a removable tooling with adjustable window illustrated respectively in position before mounting, in position with a window of maximum width, in position with a window of median width and in position with a window of reduced width.

FIG. 6 is a perspective view of an exemplary embodiment of a portable device equipped with a removable tooling with an adjustable window illustrated in FIG. 5.

FIG. 7 is a perspective view of a portable device according to the invention equipped with a removable tooling with two support barrels.

FIG. 8A is a perspective view illustrating a portable device according to the invention able to be used with a removable tooling forming part of a stationary machine for vertically guiding the portable device.

FIG. 8B is a view similar to FIG. 8A and showing an example of mounting the portable device on a stationary guide machine.

FIG. 8C is a view similar to FIG. 8B with the mounting in the inverted position of the portable device on a stationary guide machine.

DESCRIPTION OF EMBODIMENTS

As emerges from the drawings, the object of the invention relates to a portable device 1 ensuring the production of a marking on a surface of a part or of an object in the general sense. The device 1 according to the invention includes a casing 2 having for example a general parallelepiped shape and equipped with at least one handle and in the example illustrated a single handle 3. The casing 2 has opposite a rear face 5, an open front face 6 having an opening 6A to allow the passage of a marking member 7.

In a known manner, the marking member 7 is part of a marking system of the electromagnetic micro percussion type. This marking member 7 such as a marking tip has an end intended to impact the surface of an object in order to produce an impact point or a substantially punctual mark thereon. The marking member 7 thus undergoes an alternating translation along its axis to impact the surface to be marked. Conventionally, the marking member 7 is moved in two directions perpendicular to each other in order to produce a two-dimensional marking formed of a set of punctual conformations produced by the marking member. The marking system is not described more precisely because it does not form part of the object of the invention and is well known to the person skilled in the art. Such a marking system is installed inside the casing 2 and powered directly by the mains or by a battery integrated into the casing 2.

The casing 2 also includes a connecting body between the rear 5 and front 6 faces, formed by at least one top wall 9 extended on either side by two opposite side walls 10. In the example illustrated, the two side walls 10 are interconnected by a bottom wall 11 extending opposite and at a distance from the top wall 9. As apparent from the example illustrated in the drawings, the handle 3 projects from the bottom wall 11. Of course, it can be considered to equip the casing 2 with two handles extending for example on either side of the casing from the side walls 10.

As clearly emerges from the Figures, the casing 2 thus has a rigid body of rectangular section formed by the top wall 9, the bottom wall 11 and the two side walls 10, interconnected to form a rigid body. The rear face 5 of the casing forms, for example, a pushing or bearing surface for an operator. It should be noted that the terms top and bottom are taken for reasons of clarity into consideration of a condition of use of the device by an operator whose visual field is located on the side of the top wall 9. Of course, the device can be used in any tilted, vertical or below position (see FIG. 8C) so that the person skilled in the art will easily adopt the designation of the walls.

In accordance with the invention, the front face 6 of the casing 2 is provided with a stiffening frame 15 internally defining the passage opening 6A for the marking member 7. As explained above, the opening 6A has a rectangular shape to allow the passage and movement of the marking member 7 so that the stiffening frame has a rectangular shape completely surrounding the passage opening 6A. As illustrated in FIG. 2, this stiffening frame 15 thus includes two horizontal branches 15A parallel to each other and interconnected by two vertical branches 15B. Advantageously, the horizontal branches 15A and the vertical branches 15B are flat so that the stiffening frame 15 has a flat surface, on the side of its face turned towards the outside of the casing 2. According to the exemplary embodiment illustrated in FIG.

2, the stiffening frame 15 is attached to the front face 6 of the casing 2 by a fastening system 16 of all types known per se. According to the example illustrated in the drawings, this stiffening frame 15 is assembled on the front face of the casing 2 by a fastening system 16 of the screw type and includes screws 16 intended to be anchored in the front face 6 of the casing 2 and/or in the thickness of the top 9, bottom 11 and/or side 10 walls.

It should be noted that the casing 2 can be configured so as to have on its front face 6, a stiffening frame 15 which is not attached to the casing 2. According to this variant embodiment, the wall of the casing 2 which extends on the front face of the casing forms a stiffening frame 15 delimiting the passage opening 6A. This wall of the casing 2 extending on the front face of the casing may be a wall of the same type as the other walls of the casing or be reinforced in any suitable manner.

According to one feature of the invention, this stiffening frame 15 is provided with an indexing system 18 adapted to cooperate with a complementary indexing system 19 equipping each of the removable tooling belonging to a series of removable tooling 20A, 20B, 20C, . . . allowing to ensure positioning of the portable marking device 1 on the surface of the part to be marked. It must be understood that the portable marking device 1 is intended to be used with one of the tooling of a series of removable tooling, each removable tooling 20A, 20B, 20C, . . . of the series being configured to adapt in particular to the shape and/or dimensions of the surface of the part to be marked.

According to another feature of the invention, each removable tooling 20A, 20B, 20C, . . . and the stiffening frame 15 of the casing 2 include at least one of the elements of a magnetic assembly system 21A, 21B with two elements, namely a magnet 21A on the one hand and a ferromagnetic material 21B on the other hand. Each removable tooling 20A, 20B, 20C, . . . can thus be mounted on the portable device 1, correctly by the presence of an indexing system 18, 19 and quickly by the implementation of a magnetic assembly system 21A, 21B.

The indexing systems 18, 19 can be produced in different ways to help the correct positioning of the removable tooling on the front face 6 of the casing 2. According to an alternative embodiment not shown in the drawings, these indexing systems 18, 19 can be achieved, for example, by centering brackets projecting into the corners of the stiffening frame 15 and together delimiting a positioning housing for a complementary rib belonging to each removable tooling. Another variant embodiment is to produce the indexing systems 18, 19 by means of reference lines drawn on the stiffening frame 15 to serve as a positioning mark for positioning flanges arranged on each removable tooling 6.

According to a preferred exemplary embodiment illustrated in the drawings, the stiffening frame 15 is provided with an indexing system 18 produced in the form of a centering system adapted to cooperate with a complementary centering system 19 equipping a removable tooling 20A, 20B, 20C, . . . .

According to one embodiment feature, the centering system 18 of the stiffening frame 15 and the complementary centering system 19 of at least one removable tooling 20A, 20B, 20C, . . . are configured to be either symmetrical or asymmetrical so as to allow a mounting which is respectively reversible or with a foolproof function. A centering system 18, 19 produced symmetrically allows the removable tooling to be mounted on the front face of the casing without worrying about its left/right orientation on the front face. In an asymmetric configuration, the removable tooling can be mounted on the front face 6 of the casing 2 in a single orientation position.

The centering system 18 as well as the complementary centering system 19 can be produced in different ways. According to a preferred exemplary embodiment illustrated in the drawings, the centering system 18 and the complementary centering system 19 are of the interlocking type including male and/or female elements cooperating with respectively complementary female and/or male elements. According to the exemplary embodiment illustrated in the drawings, the stiffening frame 15 is provided with an interlocking centering system 18 including at least two male elements such as studs intended to cooperate with two complementary female elements 19 carried by a removable tooling 20A, 20B, 20C, . . . such as a hole with a shape complementary to the stud. As emerges more specifically from FIG. 2, the stiffening frame 15 thus includes two studs 18 each projecting from a vertical branch 158 of the stiffening frame 15. Each stud 18 is intended to interlock inside a complementary hole 19 made in a tooling 20A, 208, 20C, . . . .

In the case where the centering system is symmetrical, the two studs are arranged symmetrically on the stiffening frame 15. Likewise, each removable tooling 20A, 20B, 20C, . . . is provided with two holes 19 arranged symmetrically to engage in the studs of the stiffening frame 15 in two reverse orientation positions of the removable tooling. In the case where the centering system has a foolproof function, it can be considered to produce the studs asymmetrically or to place an additional stud cooperating with a complementary hole to allow the removable tooling to be mounted in a single position determined relative to the casing.

Within the same meaning, it should be noted that according to the example illustrated in the drawings, the stiffening frame 15 is provided with two studs 18 while the removable tooling is arranged to have the two holes 19 of complementary shape. Of course, it can be considered that the stiffening frame 15 is provided with one or more male elements and one or more female elements cooperating with complementary female and male elements arranged on each removable tooling. Likewise, the stiffening frame 15 can be provided with female elements cooperating with complementary male elements arranged on each removable tooling.

According to a preferred variant embodiment, each removable tooling 20A, 20B, 20C, . . . includes a mounting frame 26 provided with the additional indexing system 19 and intended to bear on the stiffening frame 15 of the casing. This mounting frame 26 includes two cross members 26A parallel to each other and interconnected by two uprights 26B parallel to each other. This mounting frame 26 internally delimits a passage window 26C for the marking member 7. Advantageously, the window 26C of the mounting frame 26 of the removable tooling has dimensions substantially identical to the opening 6A of the stiffening frame 15. When mounting a removable tooling, the mounting frame 26 of a removable tooling is in a position superimposed on the stiffening frame 15 allowing a good distribution of the forces imposed on the removable tooling. Advantageously, the two cross members 26A and the two uprights 26B are flat so that the mounting frame 26 has a flat surface on the side of its face turned towards the outside of the removable tooling. Each removable tooling 20A, 206, 20C, . . . cooperates through its mounting frame 26, with the stiffening frame 15, by a flat bearing.

According to this preferred variant embodiment, each mounting frame 26 of the removable tooling is provided with the complementary centering system 19 as described above. According to the exemplary embodiment illustrated in the drawings, the two holes 19 of the centering system are provided in the two uprights 26B of the mounting frame 26.

In the case where each removable tooling includes a mounting frame 26 then this mounting frame 26 includes at least one of the two elements of the magnetic assembly system 21A, 21B. In other words, it should be understood that each removable tooling 20A, 20B, 20C, . . . is fastened by its mounting frame 26 on the front face of the casing by means of the magnetic assembly system 21A, 21B with two elements, namely a magnet 21A on the one hand and a ferromagnetic material 21B on the other hand. The stiffening frame 15 and the mounting frame 26 include at least one of the two elements, namely a magnet 21A and a ferromagnetic material 21B of the magnetic assembly system.

For example, the mounting frame 26 can be made of a ferromagnetic material 21B while the stiffening frame 15 is provided with one or more magnets 21A. Conversely, it can be considered to make the stiffening frame 15 of a ferromagnetic material while each mounting frame 26 of the removable tooling is equipped with one or more magnets 21A. Also, it should be noted that the stiffening frame 15 and the mounting frame 26 can be entirely or partly made of a ferromagnetic material, each being equipped with one or more magnets.

According to the exemplary embodiment illustrated in the drawings, the stiffening frame 15 of the front face of the casing is magnetized while the mounting frame 26 of the removable tooling has at least a portion made of ferromagnetic material to cooperate with the magnetized portion of the stiffening frame. Such a solution allows to limit the number of magnets used regardless of the number of removable tooling used. As emerges more specifically from the example illustrated in FIG. 2, the stiffening frame 15 includes at least one magnet and in the preferred example four magnets 21A located substantially at each corner of the stiffening frame 15. For example, each magnet 21A of punctual shape is attached to the stiffening frame 15. Of course, this stiffening frame 15 can be entirely or partly made in the shape of a magnetized structure. These magnets 21A provide a magnetic force of attraction for the mounting frame 26 including a portion made of ferromagnetic material cooperating with each magnet 21A when the mounting frame 26 is in the position of superposition with the stiffening frame 15. Preferably, the whole mounting frame 26 is made of a ferromagnetic material such as E24 steel which can be galvanized.

It emerges from the description that the implementation of removable tooling with a mounting frame 26 facilitates the operations of installing the tooling on the front face of the portable device. The operations of changing removable tooling can be carried out quickly without requiring the use of tools. Mounting and dismounting operations between a removable tooling and the portable device may be limited to translations towards and away from each other. The fastening of the removable tooling is ensured by the magnetic attraction of the magnets and optionally supplemented by the adhesion forces due to the interlocking of the male elements 18 in the female elements 19. It should be noted that the magnetic attraction of the magnets 21A is adapted to human manual force so as to allow dismounting or removing the tooling removable from the portable device without tools.

It should be noted that the need, under certain conditions of use, to achieve a complete connection between the removable tooling and the portable device 1 may appear. To meet this need, the two male elements 18 of the stiffening frame 15 are each extended by a threaded rod 27 intended to pass through the female elements 19 of at least one removable tooling so as to receive a fastening nut 28. As shown in FIG. 6, the nut 28 ensures the fastening of the mounting frame 26 on the stiffening frame 15 and consequently of the removable tooling on the portable device 1.

The following description describes by way of non-limiting examples, various removable tooling provided with a mounting frame 26 adapted to allow their mounting on the front face of the portable device 1. FIGS. 1 and 3 illustrate a first exemplary embodiment of a removable tooling 20A intended more particularly for marking flat surfaces and tubes. This removable tooling 20A includes a support frame 30 located at a distance and in front of the mounting frame 26, having a passage opening 31 for the marking member 7. The opening 31 is located substantially in the extension of the window 26C of the mounting frame 26 and of the opening 6A of the stiffening frame 15. For example, the opening 31 has the same dimensions as the window 26C of the mounting frame 26 and as the opening 6A of the stiffening frame 15.

This support frame 30 thus includes two side jambs 30A parallel to each other, interconnected by two cross members 30B parallel to each other, and together internally delimiting the opening 31. Advantageously, the two cross members 30B are superimposed flat blades extending together in a common plane allowing a flat bearing on a flat surface to be marked. For example, the two side jambs 30A each have a V-shape, the tip of which is directed towards the mounting frame 26, these side jambs 30A being intended to bear on the generatrixes of a tube to be marked. This support frame 30 is connected to the mounting frame 26 by means of at least one and in the example, two connection arms 32 extending laterally between each side jamb 30A of the support frame and each upright 26B of the mounting frame 26.

FIG. 1 also illustrates a second exemplary embodiment of a removable tooling 20B also including a support frame 30 located at a distance and in front of the mounting frame 26 as described above. According to this example, the support frame 30 is provided on its outer face with magnets 34 located in particular in each of its corners and intended to cooperate with the surface to be marked. According to this variant embodiment and unlike the first exemplary embodiment of the removable tooling 20A, the two side jambs 30A are rectilinear.

FIGS. 1 and 4 to 6 illustrate a third exemplary embodiment of a removable tooling 20C having an adjustable window with regard to the surface to be marked. According to this advantageous exemplary embodiment, this removable tooling 20C with an adjustable window includes a fixed side jamb 35 projecting from one side of the mounting frame 26 and a removable side jamb 36 magnetically fastened on the mounting frame 26. The fixed side jamb 35 and the removable side jamb 36 define therebetween an adjustable window 37 for passage of the marking member 7, positioned in front of the mounting frame 26. In the example illustrated, the fixed side jamb 35 and the removable side jamb 36 each have a straight support edge 38 on the surface to be marked. For example, each support edge 38 is also provided with a recessed V-shaped indentation 39 for bearing on a tube. Of course, the shape of the bearing surface in contact with the surface to be marked can be produced in a different way.

The adjustable passage window 37 extends in its maximum position, in the extension of the window 26C of the mounting frame 26 and of the opening 6A of the stiffening frame 15. The fixed side jamb 35 extends substantially at right angle from an upright 26B of the mounting frame 26 while the removable side jamb 36 extends perpendicular to the mounting frame 26 while being able to be positioned at the other upright 26B of the mounting frame 26 when this tooling has its passage window with the greatest width (FIG. 4).

The removable side jamb 36 and the mounting frame 26 of the removable tooling with adjustable window 20C include an adjustable system 40 for positioning the removable side jamb 36 along the cross members 26A of the mounting frame 26. This positioning system 40 allows the removable side jamb 36 to be mounted on the mounting frame 6 in various positions allowing the spacing of the removable side jamb 36 to be adjusted relative to the fixed side jamb 35. This positioning system 40 can be achieved in any appropriate way by interlocking male and female elements for example.

According to the exemplary embodiment illustrated in the drawings, this positioning system 40 includes a notching delimiting the housings 41 and arranged on the upper and lower cross members 26A of the mounting frame 26 of the removable tooling with an adjustable window. These housings 41 which are for example regularly separated by notches are arranged on the surface of the cross members, outside the window 26C of the mounting frame 26. The removable side jamb 36 is provided with at least one magnet 43 and two superimposed hooks 44 intended to engage in two superimposed housings 41 of the upper and lower cross members 26A to position the removable side jamb 36 in a position of separation determined relative to the fixed side jamb 38. The removable side jamb 36 is provided at right angle, with two tabs 45 each provided with a hook 44 and two magnets 43.

Thus, the magnets 43 of each tab 45 exert an attraction force on the cross members 26A of the mounting frame 26, of course made of a ferromagnetic material. The removable side jamb 36 can thus be securely fastened on the mounting frame 26. The removable side jamb 36 can occupy all possible positions along the cross members 26A of the mounting frame 26 by choosing the superimposed pair of housings 41 into which are engaged the hooks 44. It is thus possible to adjust at will the size of the passage window 37 for the marking member 7. Of course, the magnetic attraction of the magnets 43 is adapted to the human manual force so as to allow dismounting or removing the removable side jamb 36 from the mounting frame 26 of the removable tooling with adjustable window 20C without tools.

FIG. 7 illustrates a fourth exemplary embodiment of a removable tooling 20D including a mounting frame 26 including two support barrels 50 projecting laterally on either side of the mounting frame and more specifically of the two uprights 266 of the mounting frame 26. Such a removable tooling thus has at the end of the support barrels 50, two punctual surfaces 51 for bearing on the surface to be marked defining therebetween a passage opening for the passage member 7.

FIGS. 8A to 8C illustrate a fifth exemplary embodiment of a removable tooling 20E forming part of a platen 60 fastened on a sliding carriage 61 of a vertical guide column 62 of a fixed guide machine 63. The carriage 61 is guided in vertical movement by the column 62. The carriage 61 supports in a cantilevered fashion the platen 60 which is in the shape of a horizontal plate in which is formed the passage window 26C for the marking member 7. This platen 60 delimits around the window 26C, the mounting frame 26 of a removable tooling as described above. The mounting frame 26 also includes the additional centering system, namely the two holes 19 in the example illustrated, arranged in the two uprights 26B of the mounting frame. Advantageously, the mounting frame 26 is bordered by stiffening flanges 60A rising at right angles from the platen 60 to help stiffen it. The platen 60 is made of a ferromagnetic material so that the magnets 21A carried by the portable device 1 can exert their force of attraction on the mounting frame 26.

This stationary machine 63 includes a laying table 64 for the part to be marked above which is positioned the removable tooling 20E fastened on the sliding carriage 61. The portable device 1 can be mounted on this removable tooling 20E so that the stationary guide machine 63 is transformed into a stationary marking machine. The assembly operations between this removable tooling 20E and the portable device 1 remain simple and identical to the other exemplary embodiments described above. This removable tooling 20E allows to receive the portable device 1 in one or the other of its positions (FIGS. 8B and 8C) allowing a stable positioning of the portable device on the carriage 61.

The invention claimed is:

1. A portable device for marking a surface, including a casing (2) equipped with at least one handle (3) and having a front face (6) having a rectangular opening (6A) for the passage of a marking member (7) forming part of a marking system and adapted to produce at least one substantially punctual mark, this marking member being moved over the surface to be marked, in a two-dimensional marking area, the device being characterized in that the front face (6) of the casing is provided with a stiffening frame (15) surrounding the passage opening for the marking member, this stiffening frame (15) being provided with an indexing system (18) adapted to cooperate with a complementary indexing system (19) equipping each of the tooling of a series of removable tooling (20A, . . . , 20E) for positioning the device on the surface to be marked, each removable tooling (20A, . . . , 20E) of the series and the stiffening frame (15) including at least one of the elements of a magnetic fastening system with two elements, namely a magnet (21A) and a ferromagnetic material (21B).

2. The portable device according to claim 1, wherein the stiffening frame (15) is provided with an indexing system (18) including a centering system adapted to cooperate with a complementary centering system (19) of the indexing system equipping at least one removable tooling (20A, . . . , 20E).

3. The portable device according to claim 2, wherein the stiffening frame (15) of the front face of the casing is provided with a centering system (18) by interlocking including at least two male and/or female elements intended to cooperate with two complementary female and/or male elements (19) carried by the mounting frame of at least one removable tooling (20A, . . . , 20E).

4. The portable device according to claim 3, according to which at least two male elements (18) of the stiffening frame (15) of the front face of the casing are each extended by a threaded rod (27) intended to pass through the female elements (19) of the mounting frame (26) of at least one removable tooling (20A, . . . , 20E), so as to receive a nut (28) for fastening the mounting frame (26) on the stiffening frame (15).

5. The portable device according to claim 1, according to which the centering system (18) of the stiffening frame (15) and the complementary centering system (19) of at least one removable tooling (20A, . . . , 20E) are configured to be symmetrical or asymmetrical to allow a respectively reversible or foolproof mounting.

6. The portable device according to claim 1, according to which each removable tooling (20A, . . . , 20E) includes a mounting frame (26) provided with the complementary indexing system (19), each mounting frame (26) of the removable tooling (20A, . . . , 20E) of the series and the stiffening frame (15) including at least one of the two elements of a magnetic fastening system with magnet (21A) and ferromagnetic material (21B).

7. The portable device according to claim 6, according to which the stiffening frame (15) of the front face of the casing is magnetized while the mounting frame (26) of the removable tooling (20A, . . . , 20E) of the series has at least a portion made of ferromagnetic material.

8. The portable device according to claim 6, according to which the mounting frame (26) of at least one removable tooling (20A, . . . , 20E) includes two side uprights (26B) parallel to each other and connected by two cross members (26A) parallel to each other.

9. The portable device according to claim 6, wherein the mounting frame (26) of at least one removable tooling (20A, 20B) includes a support frame (30) located at a distance and in front of the mounting frame (26), the support frame (30) being fastened to the mounting frame (26) using at least two connection arms (32) extending laterally between the frames.

10. The portable device according to claim 9, according to which the support frame (30) includes magnets (34) for fastening on the surface to be marked.

11. The portable device according to claim 6, wherein the mounting frame (26) of at least one removable tooling (20D) includes two support barrels (50) projecting laterally on either side of the mounting frame (26).

12. The portable device according to claim 6, wherein the mounting frame (26) of at least one removable tooling with an adjustable window (20*c*) includes a fixed side jamb (35) projecting from one side of the mounting frame and a removable side jamb (36) magnetically fastened on the mounting frame.

13. The portable device according to claim 12, wherein the removable side jamb (36) and the mounting frame (26) of the removable tooling with adjustable window (20*c*) include an adjustable system (40) for positioning the removable side jamb (36) along the cross members (26A) of the mounting frame (26).

14. The portable device according to claim 13, according to which the adjustable positioning system (40) includes a notching delimiting the housings (41) and arranged on the upper and lower cross members (26A) of the mounting frame (26) of the removable tooling with adjustable window (20C) and in that the removable side jamb (36) is provided with at least one magnet (43) and two superimposed hooks (44) intended to engage in two superimposed housings to position the removable side jamb (36) relative to the fixed side jamb (35).

15. The portable device according to claim 6, wherein the mounting frame (26) of a removable tooling (20E) is part of a platen (60) fastened on the sliding carriage (61) of a vertical guide column (62) of a stationary guide machine (63).

16. The portable device according to claim 1, according to which the stiffening frame (15) of the front face of the casing is attached to the front face of the casing by a fastening system (16).

17. The portable device according to claim 1, according to which the stiffening frame (15) of the front face of the casing is provided with point magnets (21A).

* * * * *